US006527613B2

(12) United States Patent
Weber

(10) Patent No.: US 6,527,613 B2
(45) Date of Patent: Mar. 4, 2003

(54) BATH-TIME AMUSEMENT DEVICE

(76) Inventor: James A. Weber, 6007 Timber Bend Dr., Avon, IN (US) 46123

( * ) Notice: Subject to any disclaimer, the term of this patent is extended or adjusted under 35 U.S.C. 154(b) by 0 days.

(21) Appl. No.: 10/072,565

(22) Filed: Feb. 7, 2002

(65) Prior Publication Data

US 2002/0111108 A1 Aug. 15, 2002

Related U.S. Application Data

(60) Provisional application No. 60/267,526, filed on Feb. 9, 2001.

(51) Int. Cl.[7] ..... A63H 33/40

(52) U.S. Cl. ..... 446/177; 446/153; 273/350

(58) Field of Search ..... 446/153–165, 446/177, 211, 212, 168, 166, 227, 268, 429; 273/349–350; 124/5, 16

(56) References Cited

U.S. PATENT DOCUMENTS 2,996,835 A * 8/1961 Giuliano
4,127,271 A * 11/1978 Moustakas ..... 273/100
4,223,894 A * 9/1980 Fabricant ..... 273/349
4,246,719 A * 1/1981 Kulesza et al. ..... 46/41
4,630,794 A * 12/1986 Ross ..... 248/309.1
5,078,642 A * 1/1992 Glessner ..... 446/153
5,183,429 A * 2/1993 Bitton ..... 446/73
5,344,156 A * 9/1994 Levin ..... 273/355
5,480,140 A * 1/1996 Darnell ..... 273/15 R
6,173,957 B1 * 1/2001 James, Sr ..... 273/440

* cited by examiner

*Primary Examiner*—Derris H. Banks
*Assistant Examiner*—Jamila Williams
(74) *Attorney, Agent, or Firm*—Maginot, Moore & Bowman

(57) ABSTRACT

An amusement device is configured to be attached to a surface of a bathtub. The amusement device includes a launching device movable between a rest orientation and a biased orientation. The amusement device further includes a suction assembly attached to the launching device and configured to secure the launching device to the surface of the bathtub. Additionally, the amusement device includes a target assembly configured to float on water located within the bathtub. The launching device is configured to fling an object located thereon from the launching device toward the target assembly in response to release of the launching device after it is moved from the rest position to the biased orientation. A method of using an amusement device in a bathtub is also disclosed.

13 Claims, 12 Drawing Sheets

BATH-TIME AMUSEMENT DEVICE

PROVISIONAL PATENT APPLICATION

This application claims the benefit of U.S. Provisional Application Serial No. 60/267,526 filed Feb. 9, 2001.

BACKGROUND OF THE INVENTION

The present invention relates generally to an amusement device, and more particularly to an amusement device that is used in a bathtub.

It is desirable to provide fun bath-time activities for children as an enticement to take a bath. In this regard, various amusement devices have heretofore been designed for use by children in a bathtub. For instance, toy boats have been designed which float on the water in the bathtub and provide entertainment to children while they take a bath. Also, a water soluble foam dispensing device has been commercially available wherein a child may write her name or draw pictures on the side wall of a bathtub while she is taking a bath. Thereafter, the writing or drawing can later be washed off with water. Obviously, numerous other devices for providing fun bath-time activities have been designed for the purpose of providing entertainment to children while they take a bath.

What is needed is a new type of amusement device that provides entertainment to children while they take a bath. This is especially true since children can become bored with toys that they have played with numerous times in the past, while they become intrigued with toys that are new to them. The present invention fulfills this need.

SUMMARY OF THE INVENTION

In accordance with one embodiment of the present invention, there is provided an amusement device. The amusement device includes a launching device movable between a rest orientation and a biased orientation. The amusement device further includes a suction assembly attached to the launching device and configured to secure the launching device to a surface of a bathtub. The amusement device additionally includes a target assembly configured to float on water located within the bathtub. The launching device is configured to fling an object located thereon from the launching device toward the target assembly in response to release of the launching device after it is moved from the rest position to the biased orientation.

Pursuant to another embodiment of the present invention, there is provided an amusement device. The amusement device includes a launching device having a flexible portion and a suction assembly attached to the launching device and configured to secure the launching device to a surface of a bath tub. The launching device is configured to fling an object located on the flexible portion in response to the flexible portion being flexed and thereafter released.

According to still another embodiment of the present invention, there is provided a method of using an amusement device in a bathtub, with the amusement device including a launching device and a target assembly. The method includes the steps of (i) securing a launching device to a surface of the bathtub, (ii) placing an object on the launching device after the securing step, and (iii) propelling the object with the launching device toward the target assembly which is floating on water located within the bathtub after the placing step.

According to yet another embodiment of the present invention, there is provided an amusement device. The amusement device includes a launching device movable between a rest orientation and a biased orientation. The amusement device further includes a securing mechanism attached to the launching device and configured to attach the launching device to a surface of the bathtub. The amusement device additionally includes a target assembly configured to float on water located within the bathtub. The launching device is configured to fling an object located thereon from the launching device toward the target assembly.

It is therefore an object of the present invention to provide a new and useful amusement device which can be used in a bath tub.

It is another object of the present invention to provide an improved amusement device which can be used in a bath tub.

Moreover, it is another object of the present invention to provide a new and useful method of using amusement device in a bath tub.

It is also another object of the present invention to provide an improved method of using amusement device in a bath tub.

Other objects and benefits of the present invention can be discerned from the following description and accompanying drawings.

DESCRIPTION OF THE PREFERRED EMBODIMENTS

Figure 1:
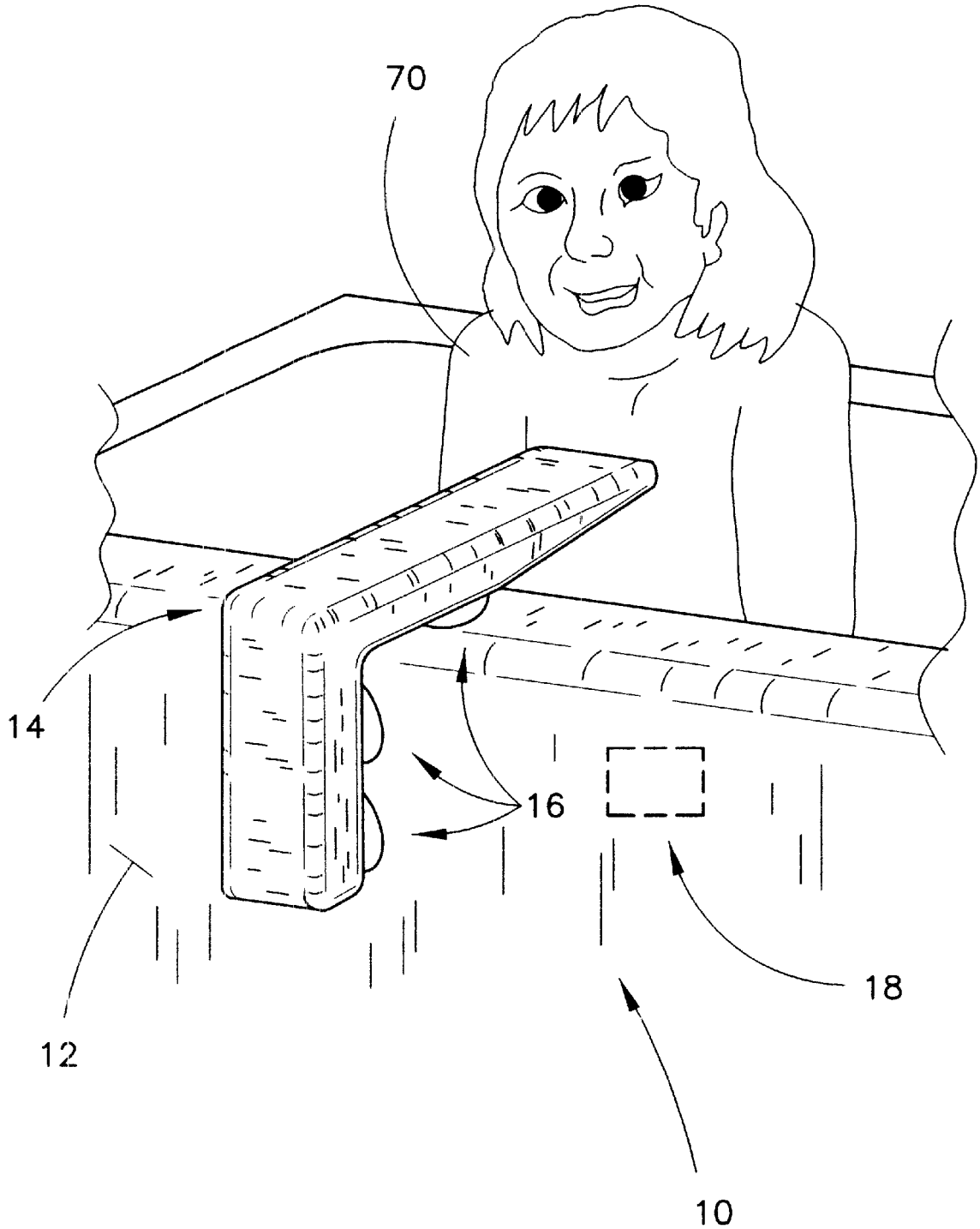
FIG. 1 is a view of a preferred embodiment of an amusement device which incorporates the features of the present invention therein, with the target assembly of the amusement device shown schematically for clarity of description.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Referring now to FIG. 1, there is shown a preferred embodiment of an amusement device 10 that incorporates the features of the present invention therein. The amusement device 10 is configured to be used in a bathtub 12, although it can alternatively be used in other environments. The amusement device 10 includes a launching device 14, a suction assembly 16, and a target assembly 18. Note that the target assembly 18 is shown in phantom in FIG. 1 for clarity of description. (See FIGS. 15 and 16 for more detailed views of the target assembly 18.)

The launching device 14 is also shown in FIGS. 2–6. In particular, the launching device 14 includes an integrally formed L-shaped member that is made of a resilient foam material. Alternatively, the L-shaped member can be made of a flexible plastic material that is configured to allow bending of its component parts. The L-shaped member includes a vertically oriented portion 20 and a horizontally oriented portion 22 which converge together at an elbow region 24. The launching device is movable between a rest orientation as shown in solid lines in FIG. 3 (see also FIG. 18) and a biased orientation as shown in phantom lines in FIG. 3 (see also FIG. 17).

The suction assembly 16 is attached to the launching device 14 and is configured to secure the launching device 14 to a surface of the bathtub 12 as shown in FIG. 1. The suction assembly 16 includes a plurality of suction cups 28. While the preferred number of suction cups 28 possessed by the suction assembly 16 is shown as being three, any number of suction cups (such as two or four) may alternatively be possessed by the suction assembly 16. FIGS. 7–10 show various views of one of the suction cups 28. In the preferred embodiment, all of the suction cups 28 are identical in construction, however, alternatively they may possess differing construction relative to each other.

Figure 2:
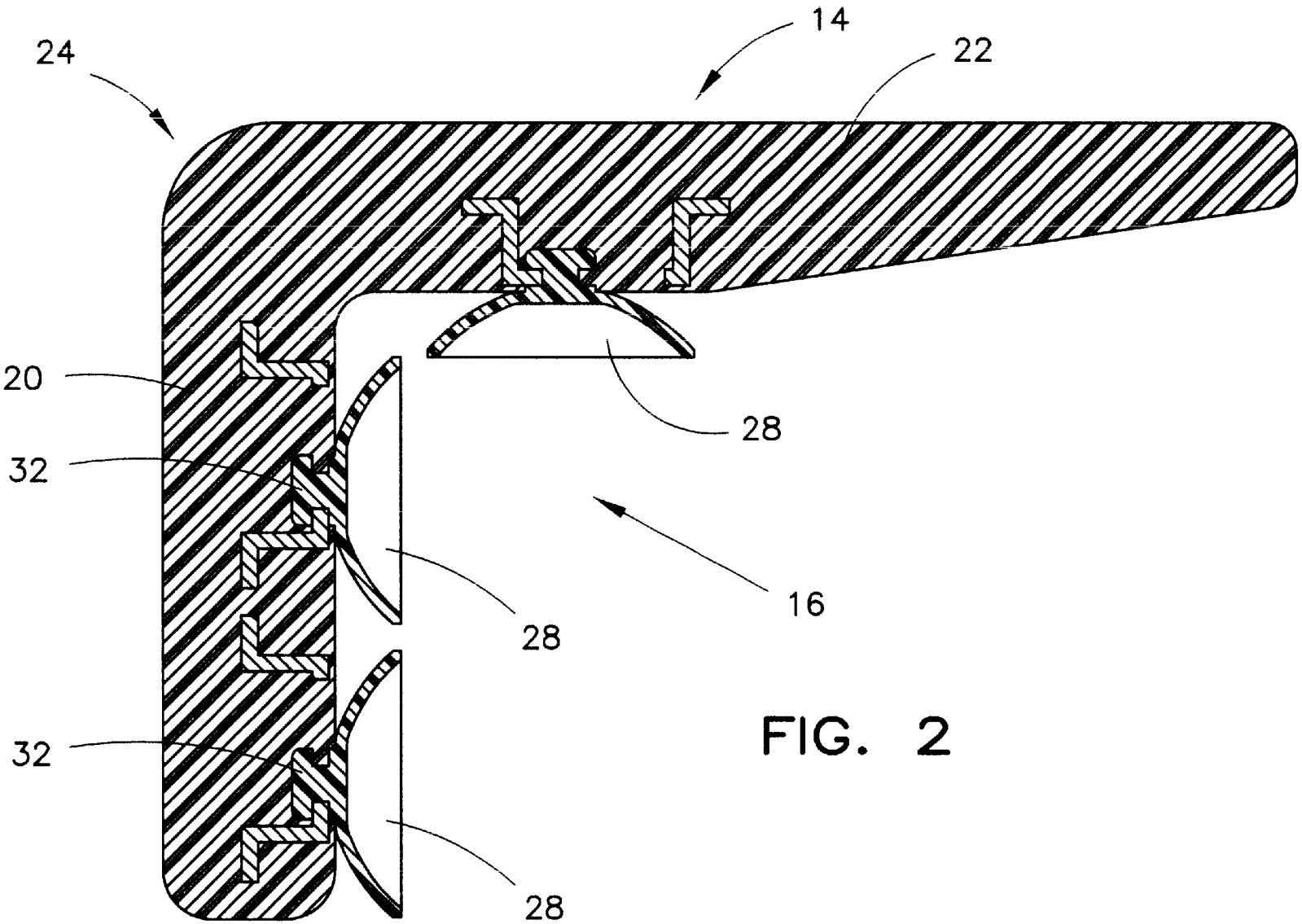
FIG. 2 is a cross-sectional view of the launching device of the amusement device taken along the line 2—2 of FIG. 6.
Figure 3:
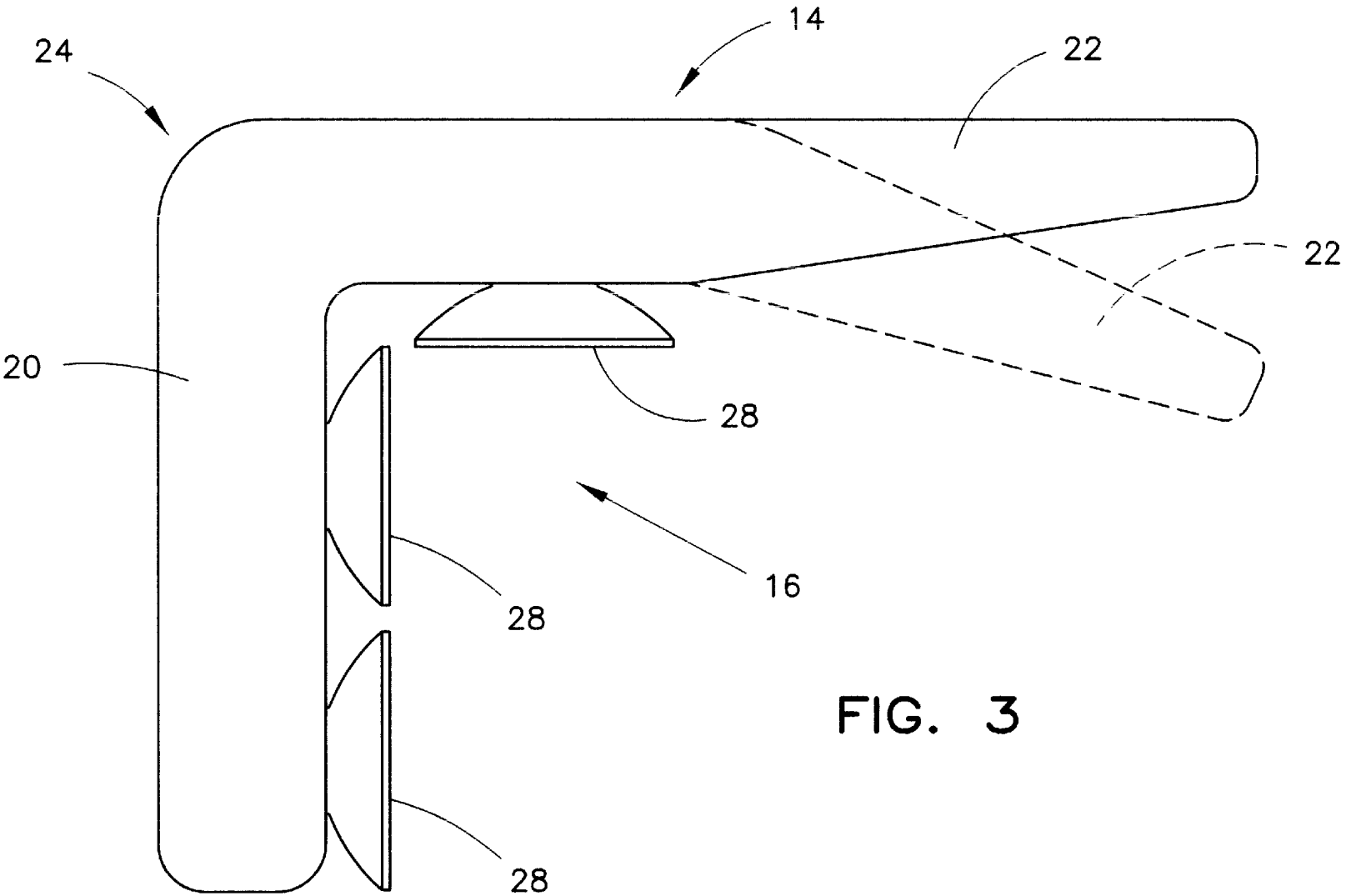
FIG. 3 is a side elevational view of the launching device of the amusement device of FIG. 1.
Figure 6:
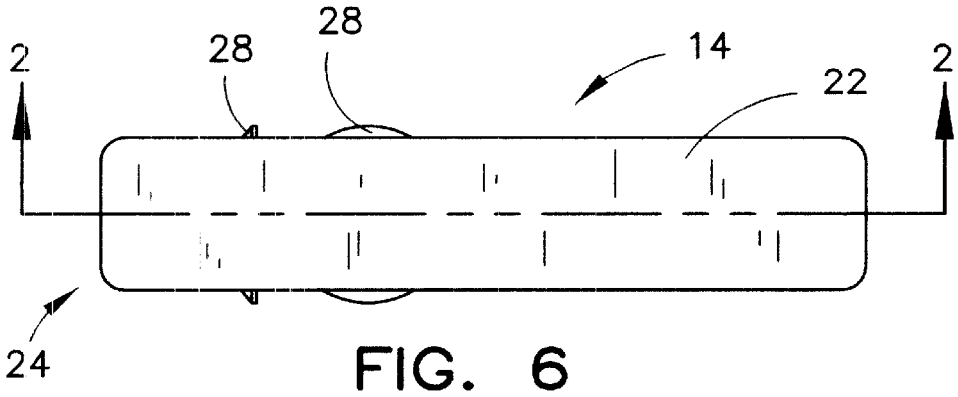
FIG. 6 is a top elevational view of the launching device of FIG. 3.
Figure 5:
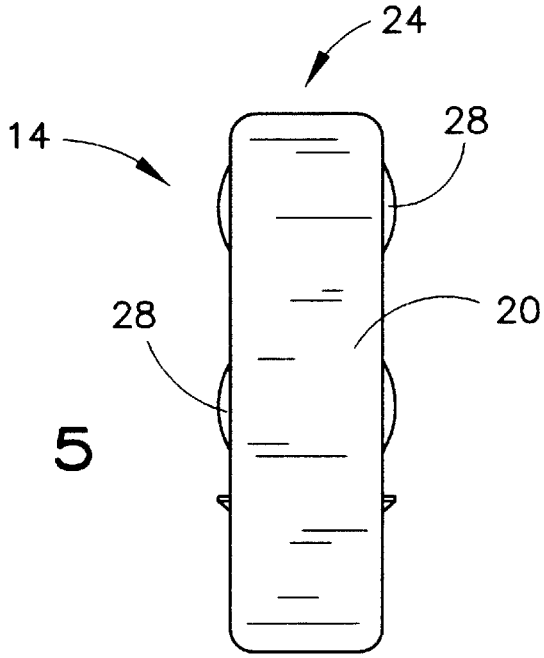
FIG. 5 is a back elevational view of the launching device of FIG. 3.
Figure 4:
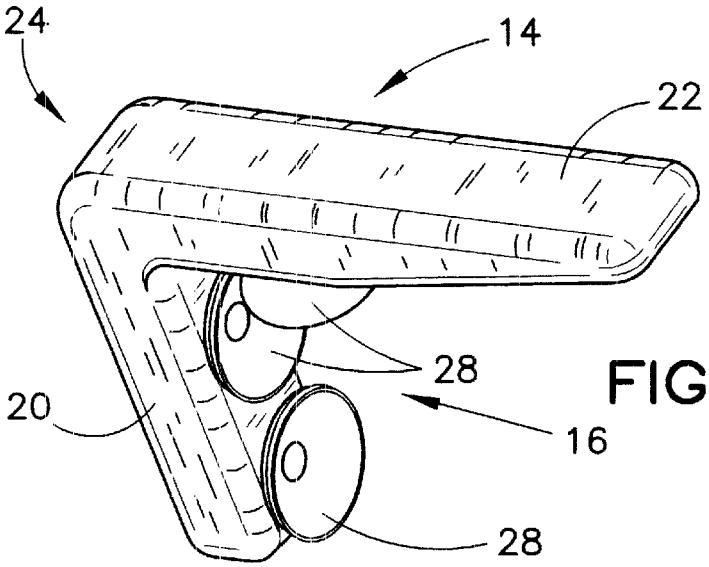
FIG. 4 is a perspective view of the launching device of FIG. 3.
Figure 7:
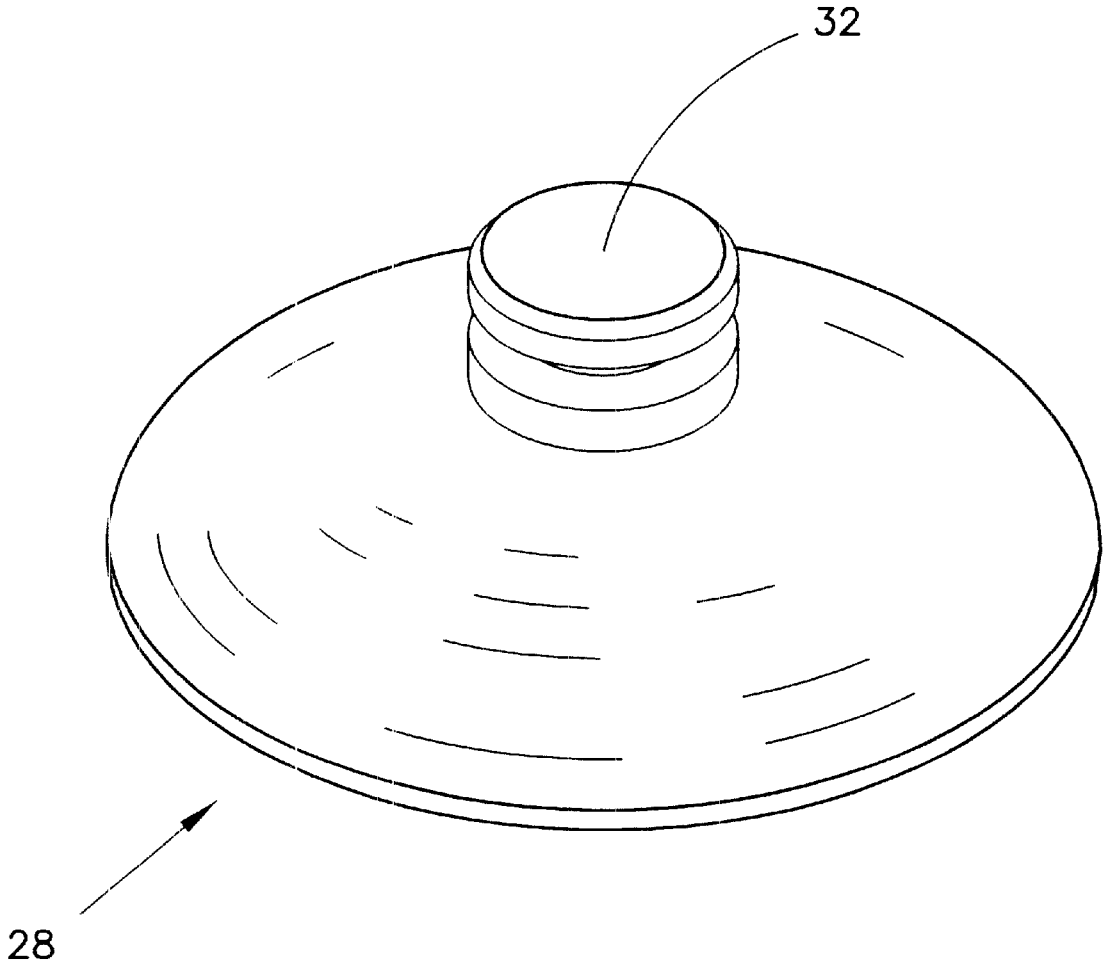
FIG. 7 is a perspective view of a suction cup of the amusement device of FIG. 1.
Figure 10:
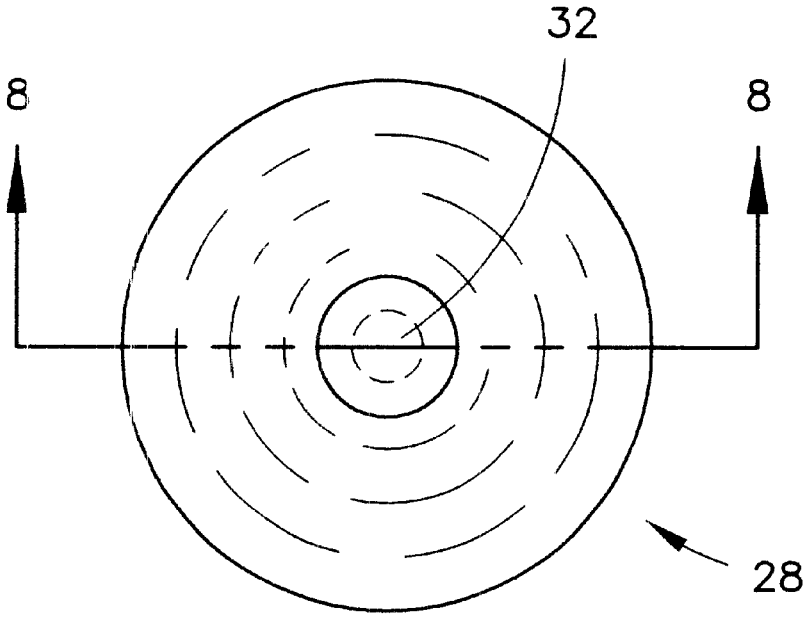
FIG. 10 is a front elevational view of the suction cup of FIG. 7.
Figure 9:
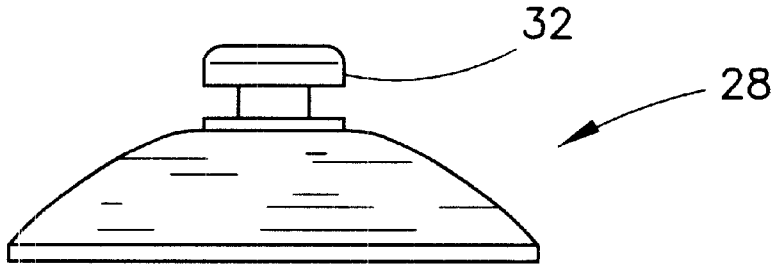
FIG. 9 is a side elevational view of the suction cup of FIG. 7.
Figure 8:
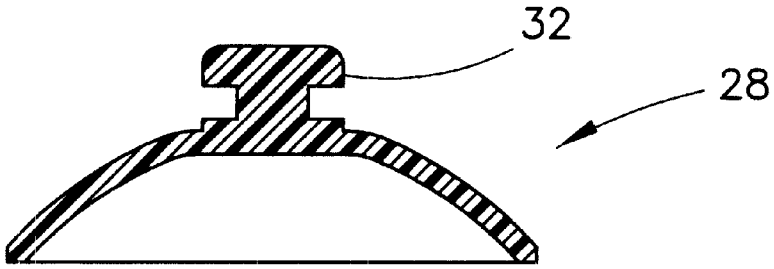
FIG. 8 is a cross-sectional view of the suction cup taken along the line 8—8 of FIG. 10.
Figure 11:
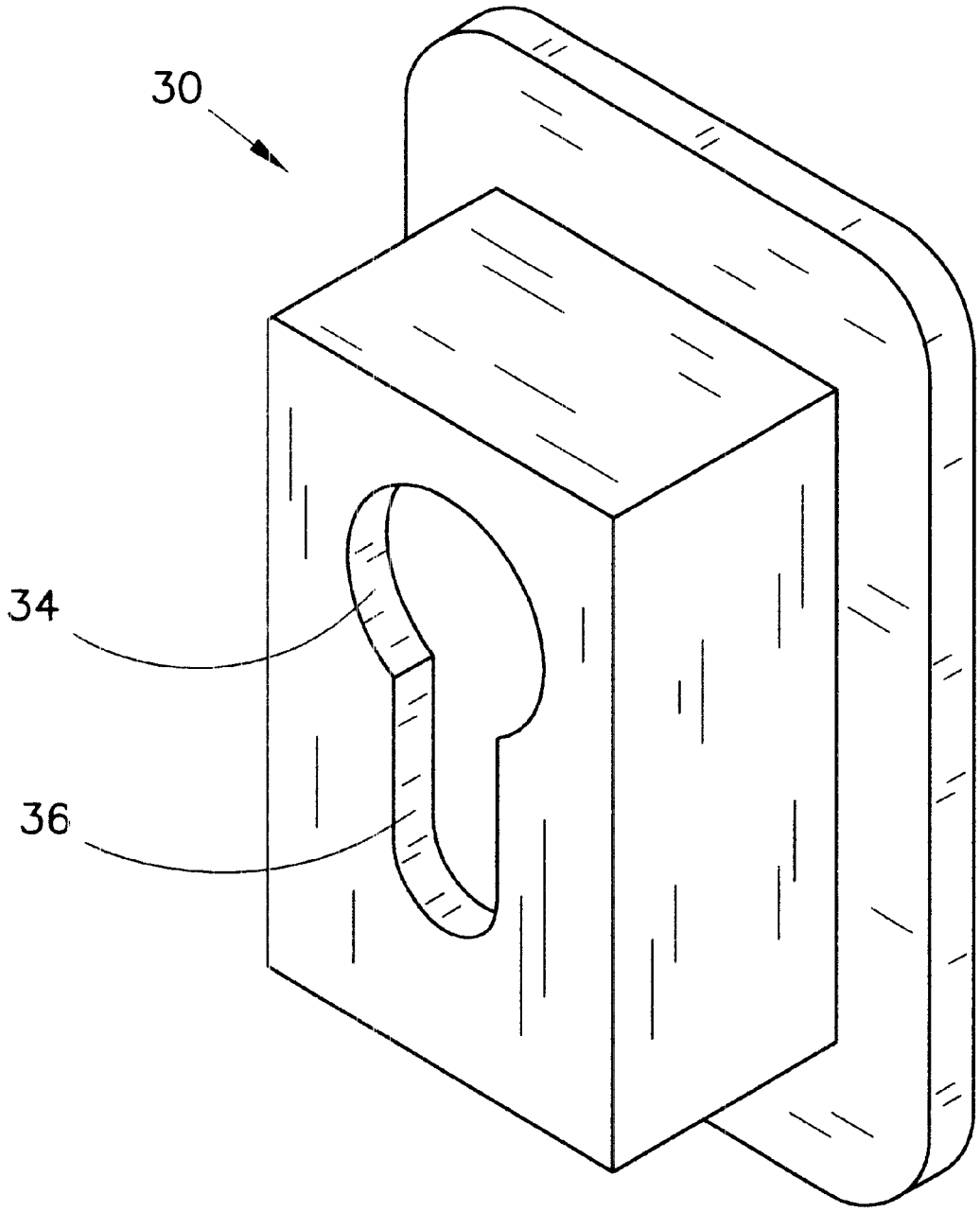
FIG. 11 is a perspective view of a suction cup retainer of the amusement device of FIG. 1.
Figure 14:
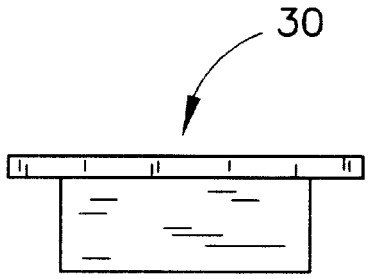
FIG. 14 is a side elevational view of the suction cup retainer of FIG. 11.
Figure 13:
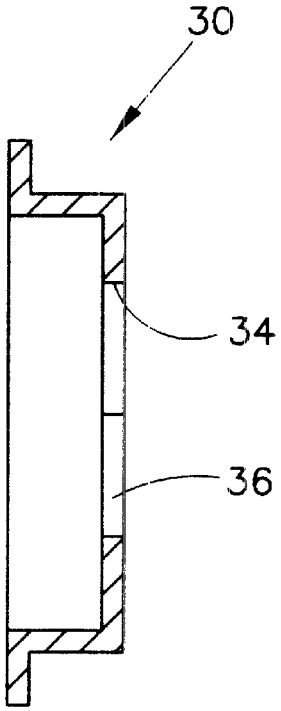
FIG. 13 is a cross-sectional view of the suction cup retainer taken along the line 13—13 of FIG. 12.
Figure 12:
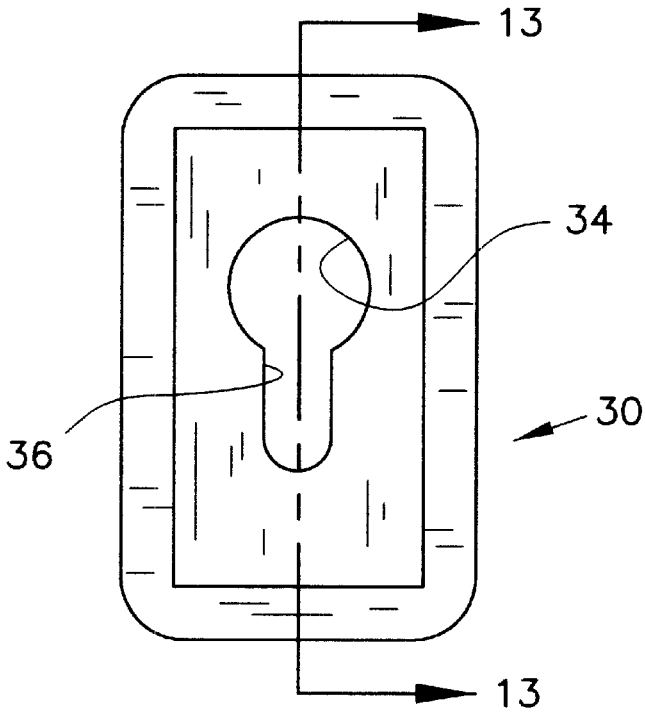
FIG. 12 is a front elevational view of the suction cup retainer of FIG. 11.

In order to secure the suction cups 28 to the launching member 14, a number of suction cup retainers 30 are integrally molded into the launching member 14 as shown in FIG. 2. FIGS. 11–14 show various views of one of the suction cup retainers 30. In the preferred embodiment, all of the suction cup retainers 30 are identical in construction, however, alternatively they may possess differing construction relative to each other. In order to secure a suction cup 28 to a corresponding suction cup retainer 30, a stub 32 of a respective suction cup 28 is inserted into an entry opening 34 of the suction cup retainer 30, and thereafter is advanced downwardly into a retaining opening 36 of the suction cup retainer 30. The stub 32 remains in the retaining opening 36 after assembly of the amusement device 10.

Figure 15:
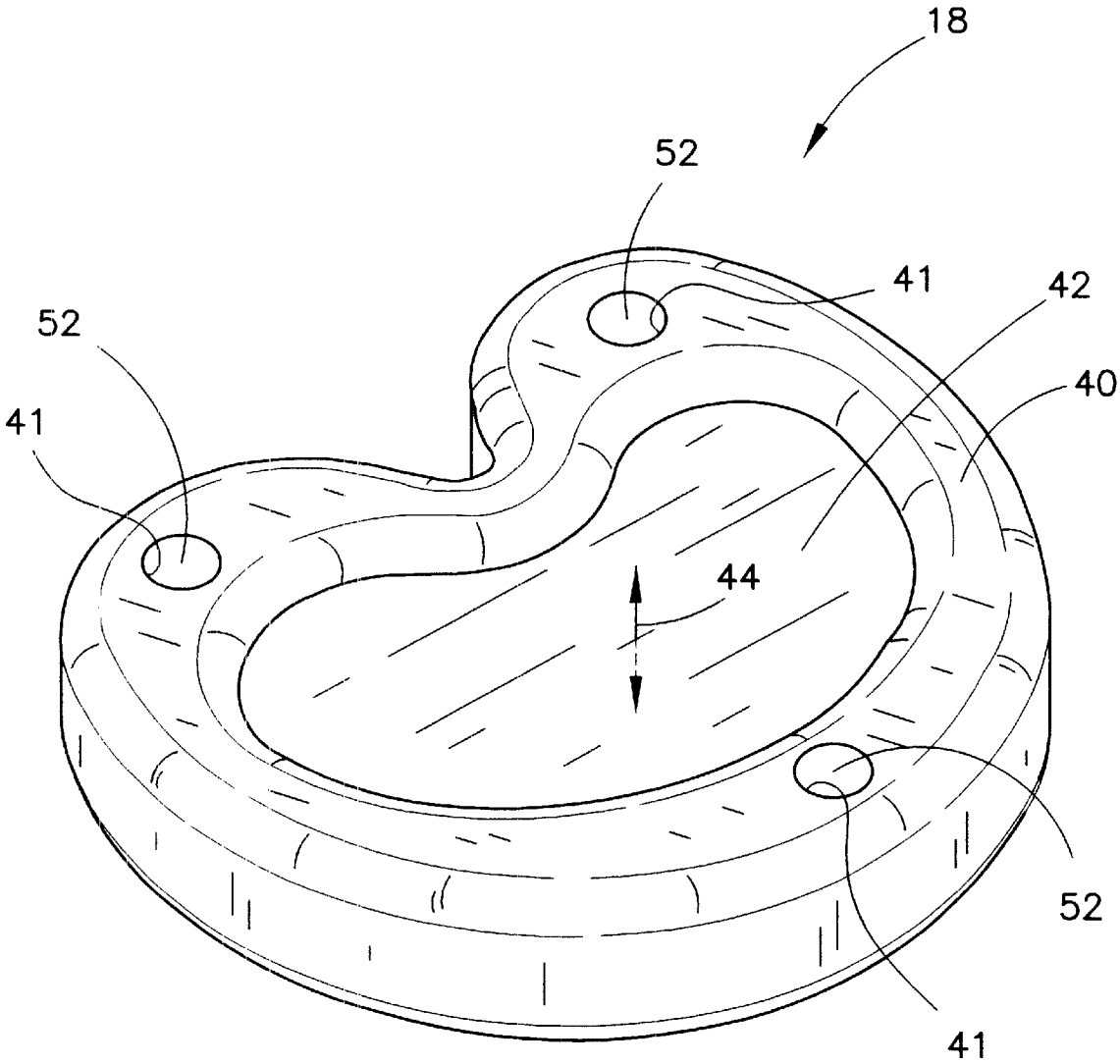
FIG. 15 is a perspective view of a target assembly of the amusement device of FIG. 1.
Figure 16:
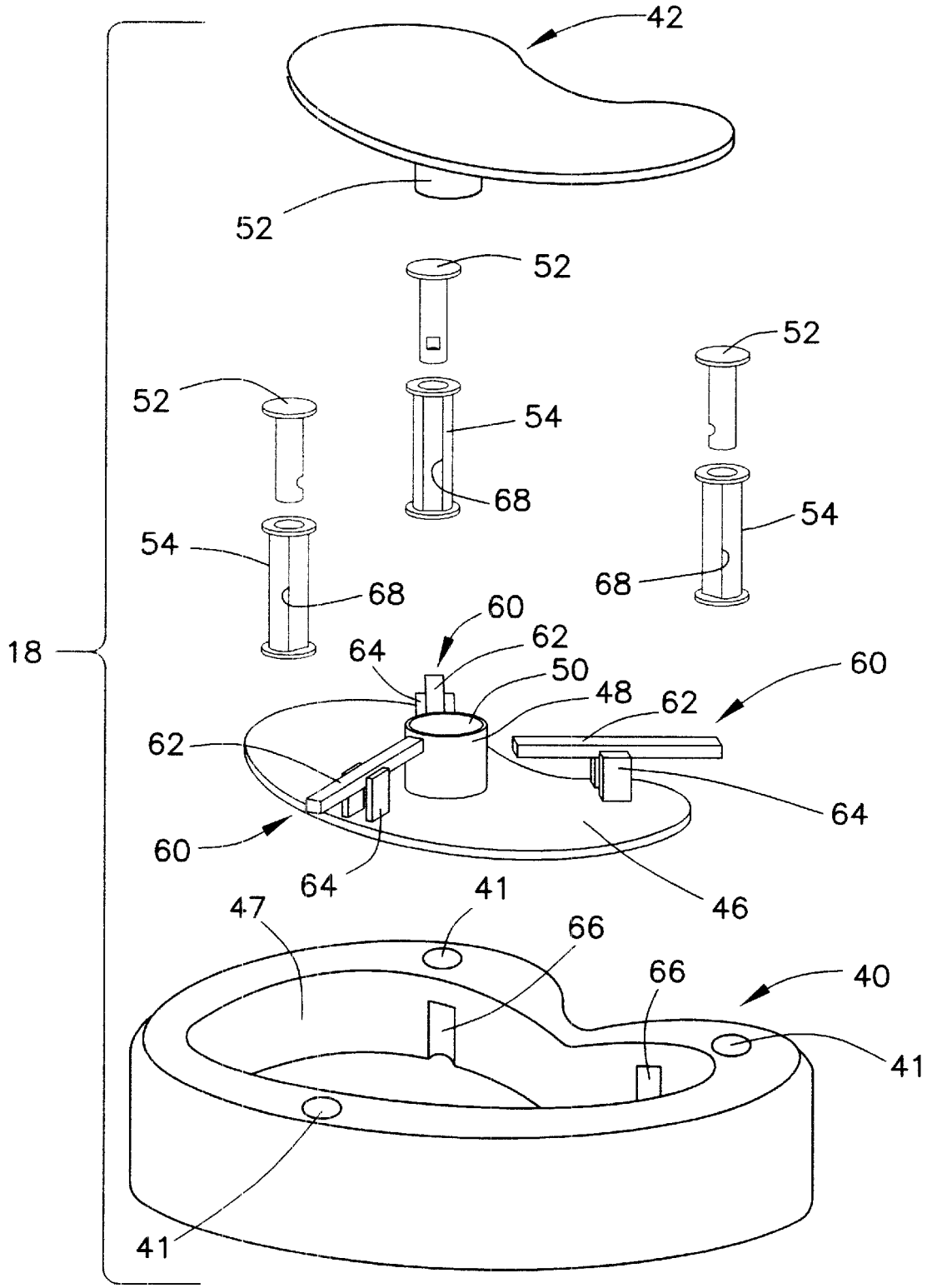
FIG. 16 is an exploded perspective view of the target assembly of FIG. 15.

The target assembly 18 is further shown in FIGS. 15 and 16. In particular, the target assembly includes a floatation device 40 that is made from a foamed material, or alternatively, may be made from a hollow plastic material. In either event, floatation device 40 is configured to float on water contained in the bathtub 12. Defined in the floatation device 40 is a plurality of indicator recesses 41 as shown in FIGS. 15 and 16. The target assembly 18 further includes a target member 42 that is supported by the floatation device 40. The target member 42 is movable in relation to the, floatation device 40 in the direction of arrow 44. (See FIG. 15.)

The target assembly 18 further includes a target base 46 that is secured in fixed relation to the floatation device 40. The target base 46 is positioned in a cavity 47 defined by the floatation device 40. The target base 46 includes a receptacle 48 that defines a recess 50 for receiving a post 52 of the target member 42. Cooperation between the receptacle 48 and the post 52 facilitates axial movement of the target member 42 relative to the target base 46.

The target assembly 18 further includes a plurality indicators 52 which are respectively positioned within the plurality of indicator recesses 41. The indicators 52 are made of a common hard plastic conventionally used in the manufacture of toys. In order to facilitate axial movement of the indicators 52 relative to the floatation device 40, a plurality of sleeves 54 are respectively mounted within the indicator recesses 41. The sleeves 54 are made of a common hard plastic that is conventionally used in the manufacture of toys. Since the sleeves 54 and the indicators 52 are each made of a hard plastic, sliding movement between each indicator 52 and its respective sleeve 54 is facilitated.

Moreover, the target assembly 18 further includes a plurality of lever assemblies 60. Each lever assembly 60 includes a lever arm 62 and a pivot mount 64. The lever arm 62 pivots about the pivot mount 64. After assembly of the amusement device 10, each lever arm extends through a respective lever aperture 66 defined in the floatation device 40 (see FIG. 16), and further through a sleeve aperture 68 defined in a respective sleeve 53 so as to contact a lower end of a respective indicator 52. Each indicator 52 may be movably coupled to a respective lever arm 62 or may merely rest on the top surface of a respective lever arm 62.

During use of the amusement device 10, a child 70 places an object 72 on the horizontally oriented portion 22 of the launching device 14. (See FIG. 17.) The object 72 is preferably configured to resemble a living creature such as a duck or a frog. (Note that if the object 72 is configured to resemble a frog, the floatation assembly 18 may be configured to resemble a lily pad.) Thereafter, the child 70 grasps and pulls downwardly on the horizontally oriented portion 22 thereby causing the launching device 14 to move from its rest orientation (see FIG. 3—solid lines) to its biased orientation (see FIG. 3—phantom lines). After the launching device 14 is bent as described above, it is thereafter released thereby causing the object 72 to be flung or otherwise propelled through the air and toward the floatation assembly 18. (See FIG. 18.)

If the shot is a direct hit, the object 72 strikes the target 42 thereby forcing it downwardly in the direction of arrow 44 (see FIG. 15). In particular, downward force applied to the target member 42 is transmitted to one end of the lever arms 62. In response, the lever arms 62 pivot about pivot mount 64 thereby causing the other end of the lever arms to force the indicators 52 upwardly and out of the indicator recesses 41 in the axial direction. Note that if the indicators 52 are respectively movably coupled to the lever arm 64, the indicators 52 would merely extend out of the indicator recesses 41 (assuming that the object remains resting on the target assembly 14 thereby maintaining a downward force on the target member 42). However, if the indicators 52 are merely respectively resting on the top surface of the lever arms 62 at the time of a direct hit (i.e. the object 72 striking the target member 42), the sudden downward force applied to the target member 42 by the strike would cause the indicators 52 to be jettisoned out of the respective indicator recesses 41.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

For example, while the suction assembly 16 is described as securing the launching device 14 to the surface of the bathtub 12 and has many advantages, it should be appreciated that other attachment mechanisms could be used to secure the launching device 14 to the surface of the bathtub 12. For example, one such attachment mechanism is a clamping device that includes two spaced apart clamp members that compress toward each other so as to secure a wall of a bathtub therebetween.

Figure 17:
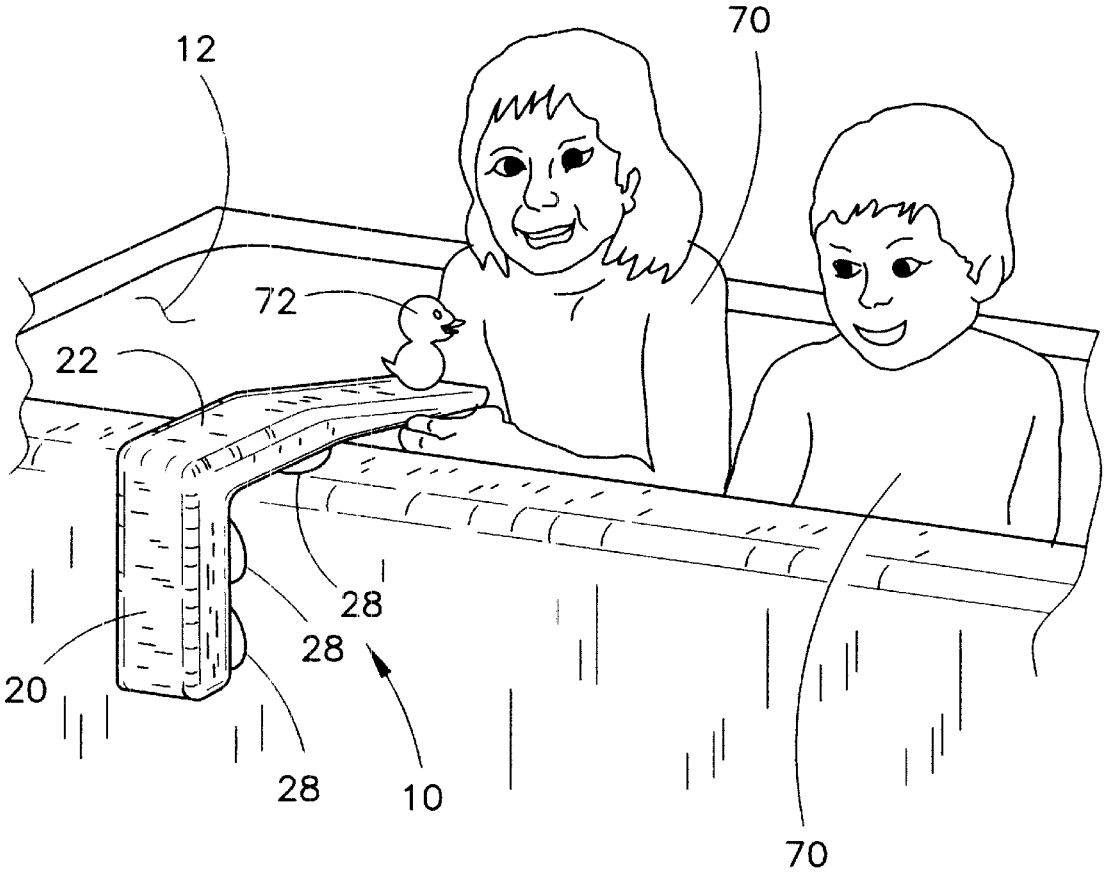
FIG. 17 is a view similar to FIG. 1, but showing an object located on the launching device while such device is positioned in its biased orientation.
Figure 18:
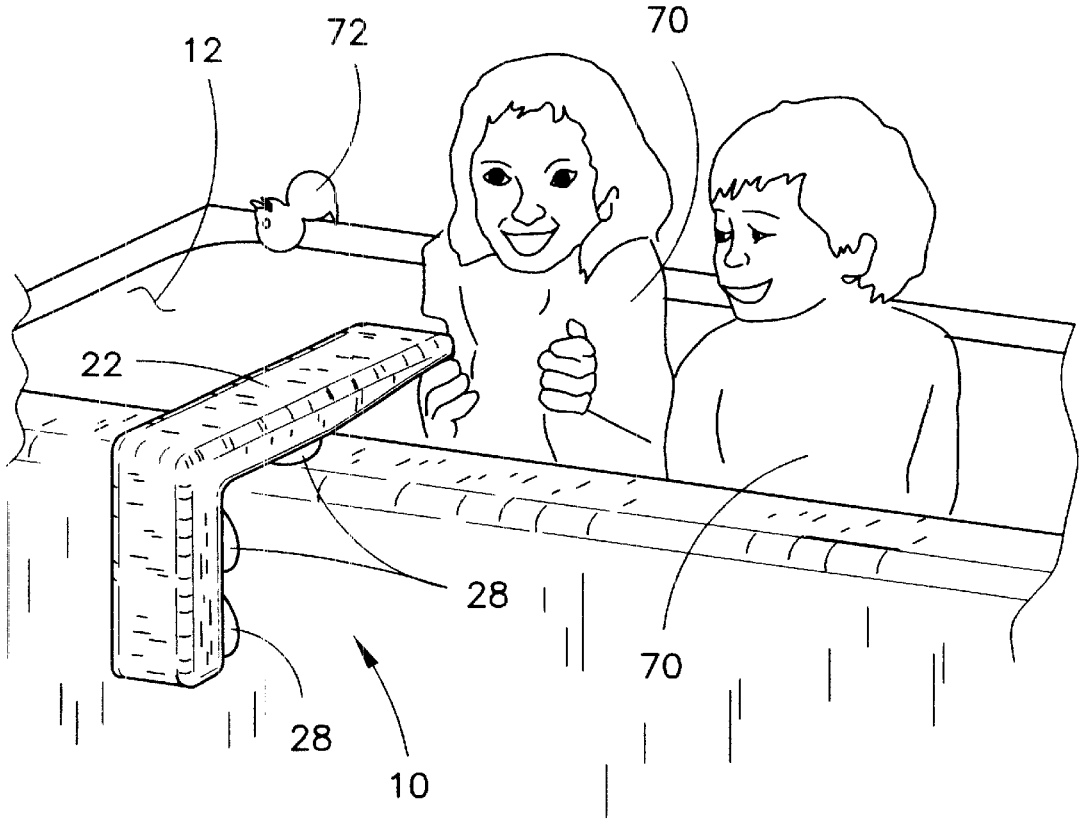
FIG. 18 is a view similar to FIG. 17, but showing the object being flung from the launching device in response to the launching device being released to return to its rest orientation.

Also, while the launching device 14 was described as being secured to a front sidewall of the bathtub 12 as shown in FIGS. 1, 17, and 18, it should be appreciated that the launching device 14 may also be secured to other sidewalls of the bathtub 12 such as the back side wall, or any wall or other surface near the bathtub 12. Of course, the physical configuration of the launching device and associated suction assembly would have to be modified to accommodate the particular surface or wall on which the launching device is mounted.

There is a plurality of advantages of the present invention arising from the various features of the amusement device described herein. It will be noted that alternative embodiments of the amusement device of the present invention may not include all of the features described yet still benefit from at least some of the advantages of such features. Those of ordinary skill in the art may readily devise their own implementations of the amusement device that incorporate one or more of the features of the present invention and fall within the spirit and scope of the present invention as defined by the appended claims.

What is claimed is:

1. An amusement device for use in a bathtub, comprising:

a launching device movable between a rest orientation and a biased orientation;

a suction assembly attached to said launching device and configured to secure said launching device to a surface of said bathtub; and a target assembly configured to float on water located within said bathtub, wherein said launching device is configured to fling an object located thereon from said launching device toward said target assembly in response to release of said launching device after it is moved from said rest position to said biased orientation, wherein said launching device includes an L-shaped member having a vertically oriented portion and a horizontally oriented portion, and wherein said suction assembly includes a first suction cup attached to said vertically oriented portion, and a second suction cup attached to said horizontally oriented portion.

2. An amusement device for use in a bathtub, comprising:

a launching device movable between a rest orientation and a biased orientation;

a suction assembly attached to said launching device and configured to secure said launching device to a surface of said bathtub; and a target assembly configured to float on water located within said bathtub, wherein said launching device is configured to fling an object located thereon from said launching device toward said target assembly in response to release of said launching device after it is moved from said rest position to said biased orientation, and wherein said target assembly includes (i) a floatation device configured to float on water located within said bathtub, and (ii) a target member supported by said floatation device.

3. The amusement device of claim 2, wherein said target member is movable in relation to said floatation device.

4. The amusement device of claim 3, further comprising an indicator, wherein;

said floatation device includes an indicator recess, said indicator is positioned in said indicator recess, and said indicator is advanced out of said indicator recess in response to said target member moving in relation to said floatation device due to said target member being struck by said object.

5. An amusement device, comprising:

a launching device having a flexible portion; and a suction assembly attached to said launching device and configured to secure said launching device to a surface of a bath tub, wherein said launching device is configured to fling an object located on said flexible portion in response to said flexible portion being flexed and thereafter released, wherein said launching device includes an L-shaped member having a vertically oriented portion and a horizontally oriented portion, and wherein said suction assembly includes a first suction cup attached to said vertically oriented portion, and a second suction cup attached to said horizontally oriented portion.

6. An amusement device, comprising:

a launching device having a flexible portion; and a suction assembly attached to said launching device and configured to secure said launching device to a surface of a bath tub, wherein said launching device is configured to fling an object located on said flexible portion in response to said flexible portion being flexed and thereafter released, further comprising a target assembly that includes (i) a floatation device, and (ii) a target member supported by said floatation device, wherein said launching device is configured to propel an object located thereon from said launching device to said target assembly.

7. The amusement device of claim 6, wherein said target member is movable in relation to said floatation device.

8. The amusement device of claim 7, further comprising an indicator, wherein:

said floatation device includes an indicator recess, said indicator is positioned in said indicator recess, and said indicator is advanced out of said indicator recess in response to said target member moving in relation to said floatation device due to said target member being struck by said object.

9. The amusement device of claim 5, wherein said object is configured to possess a shape that resembles a living creature.

10. A method of using an amusement device in a bathtub, with the amusement device including a launching device and a target assembly, comprising:

securing the launching device to a surface of said bathtub;

placing an object on said launching device after said securing step;

propelling said object with said launching device toward said target assembly which is floating on water located within said bathtub after said placing step; and advancing an indicator out of an indicator recess which is defined in said target assembly in response to said target assembly being stuck by said object.

11. The method of claim 10, wherein said securing step includes the step of securing said launching device to said surface of said bathtub with a suction assembly.

12. A method of using an amusement device in a bathtub, with the amusement device including a launching device and a target assembly, comprising:

securing the launching device to a surface of said bathtub;

placing an object on said launching device after said securing step; and propelling said object with said launching device toward said target assembly which is floating on water located within said bathtub after said placing step, wherein said launching device includes an L-shaped member having a vertically oriented portion and a horizontally oriented portion, and wherein said suction assembly includes a first suction cup attached to said vertically oriented portion, and a second suction cup attached to said horizontally oriented portion.

13. A method of using an amusement device in a bathtub, with the amusement device including a launching device and a target assembly, comprising:

securing the launching device to a surface of said bathtub;

placing an object on said launching device after said securing step; and propelling said object with said launching device toward said target assembly which is floating on water located within said bathtub after said placing step, wherein said propelling step includes the steps of (i) bending said launching device from a rest orientation to a biased orientation; and (ii) releasing said launching device after said bending step so as to cause said launching device to advance back to said rest orientation and thereby hurl said object away from said launching device and toward said target assembly.

* * * * *